United States Patent [19]

Gahagan

[11] Patent Number: 4,881,155

[45] Date of Patent: Nov. 14, 1989

[54] MULTIPURPOSE FLASHLIGHT

[76] Inventor: William L. Gahagan, 8612 - 16th Ave. NE., Seattle, Wash. 98106

[21] Appl. No.: 307,756

[22] Filed: Feb. 7, 1989

[51] Int. Cl.[4] ..... F21L 15/08

[52] U.S. Cl. ..... 362/191; 362/200; 362/396; 362/398

[58] Field of Search ..... 362/109, 191, 200, 205, 362/208, 396, 398

[56] References Cited

U.S. PATENT DOCUMENTS

| | | | |
|---|---|---|---|
| 1,075,827 | 10/1913 | Hubert | 362/200 X |
| 1,304,214 | 5/1919 | Smith | 362/200 |
| 2,774,860 | 12/1956 | Prebol et al. | 362/191 X |
| 4,215,389 | 7/1980 | Colangelo | 362/199 |
| 4,442,478 | 4/1984 | Stansbury | 362/191 |
| 4,451,871 | 5/1984 | Kirkley et al. | 362/191 X |
| 4,524,409 | 6/1985 | Yakubek | 362/189 |
| 4,575,784 | 3/1986 | Diau | 362/200 X |
| 4,644,451 | 2/1987 | Chabria | 362/189 |
| 4,739,455 | 4/1988 | Pullman | 362/189 |

*Primary Examiner*—Stephen F. Husar
*Attorney, Agent, or Firm*—Gregory W. Moravan

[57] ABSTRACT

A multipurpose safety and utility flashlight having a clip by which it can be attached to the user, and having an outwardly extending flashlight bulb which projects a hemispherical beam pattern. The clip and the flashlight bulb are located on opposite sides of the flashlight, so that when the flashlight is worn at the side of the user, the hemispherical beam pattern illuminates objects ahead of, above, behind, to the side of and at the feet of the user. In addition, the hemispherical beam pattern projects light ahead of, above, behind, and to one side of said user to make said user easily visible to others in all of those directions. The flashlight may also include a pair of magnets, one on each side of the flashlight. One magnet is suitable for magnetically mounting the flashlight to any suitable surface so the light from the flashlight shines on a work surface, while the other magnet is suitable for magnetically holding tools and parts, such as nuts, bolts and washers.

16 Claims, 1 Drawing Sheet

MULTIPURPOSE FLASHLIGHT

BACKGROUND OF THE INVENTION

The present invention relates to flashlights. More particularly, it relates to a multipurpose flashlight which is a personal safety light, such as for joggers and pets; and which is also a utility light for workmen.

SUMMARY OF THE INVENTION

In basic form the present invention comprises a battery powered, multipurpose utility and safety flashlight. When being used as a safety flashlight its clip enables it to be attached to the user, such as to a person's clothing or to the collar of a pet, so that the person or pet is more easily seen at night by the drivers of vehicles. This makes the multipurpose flashlight of the present invention particularly useful as a safety light for anyone who is out at night, such as joggers and children on bicycles.

In addition, the flashlight's light bulb may be mounted in such a way that it extends outwardly from the outer surface of the flashlight. This enables the light bulb to project light in a hemispherical beam pattern which will illuminate the ground in front of and at the feet of the user, so that he or she can see where they are going at night, particularly when the flashlight is secured to the side of the user, as at his or her belt. In addition, the hemispherical beam pattern projects light upwardly from the user, thereby illuminating things above the user. This enables the user to work on things located overhead at night, such as at a construction site. The hemispherical beam pattern, since it projects light to the front, back and above the user, also acts as a good safety light since it will also make the user visible in all of those directions to others.

Naturally, the light bulb also projects light to one side of the user since the beam pattern is hemispherical, as has been mentioned. This also acts as a safety feature, since vehicles to the side of the user, such as when the user crosses an intersection, will also be able to see the light, and thus avoid hitting the user.

In one aspect of the invention, a light bulb which has a lens formed in its tip may be used. This concentrates the light which is projected to one side of the user, making the user that much more visible to vehicles, and thus that much safer.

Reflective material may also be located on one or more surfaces of the flashlight, to reflect the lights from nearby vehicles, to help enhance the safety of the user.

In another aspect of the invention strong magnets may be located on at least two sides of the flashlight. In this way a workman can use one of the magnets to magnetically mount the flashlight to a surface near his work area so that the flashlight can illuminate it. In addition, the workman can use the other magnet(s) to hold small objects with which he may be working, such as tools, nuts, bolts, screws, etc.

In addition, the magnets can be used to magnetically attach the multipurpose flashlight of the present invention to objects being moved at night, such as to the counterweight on a crane or to structural steel being raised by a crane at night at a construction site.

It should be understood that the foregoing is intended to be a brief, not an exhaustive, summary of the objects, features, advantages and characteristics of the present invention, since these and further objects, features, advantages and characteristics of the present invention will be directly or inherently disclosed to those skilled in the art to which it pertains by the following, more detailed description of the present invention.

DESCRIPTION OF THE PREFERRED EMBODIMENTS

Figure 1:
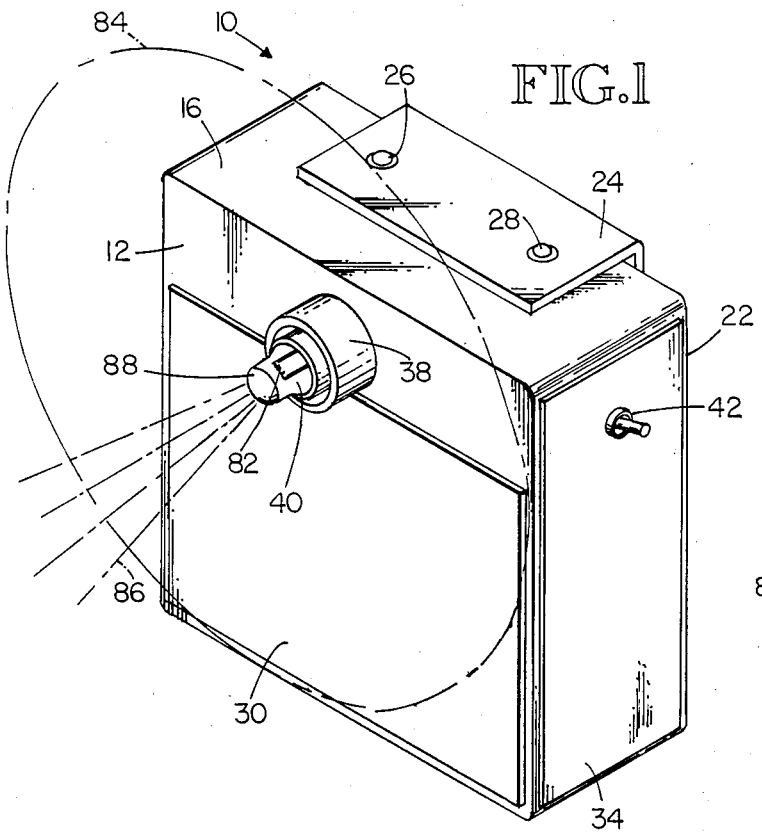
FIG. 1 is a perspective view of the present invention showing its light bulb and some of its beam patterns.

Referring now to the figures, the multipurpose flashlight of the present invention is shown generally designated at 10, and has rectangular metal or plastic front 12, back 14, top 16, bottom 18, left 20 and right 22 sides. Although flashlight 10 is illustrated as being a rectangular solid, it is understood that flashlight 10 could be made in any other shape or form.

A conventional metal or plastic spring clip 24 is secured to the flashlight 10's top 16 by any conventional means, such as by rivets 26, 28. It is understood that spring clip 24 could be any other conventional spring or clamp means. By means of spring clip 24 flashlight 10 may be releasably secured to the clothing of the user, such as to the user's belt. If the user is a pet, spring clip 24 may be used to releasably secure flashlight 10 to the pet's collar.

Strong magnets 30, 32 are secured by any conventional means, such as by gluing, to the front 12 and back 14 of flashlight 10. Although only two magnets 30, 32 are illustrated, it is understood that such magnets could also be placed on the top 16, bottom 18 and sides 20, 22 of flashlight 10. Magnets 30, 32 are strong enough to securely hold flashlight 10 in any position on any iron or steel surface. It will be appreciated that this is a great convenience and aid to a workman who is using flashlight 10, since it enables flashlight 10 to be easily magnetically mounted to any suitable nearby surface so as to illuminate whatever the workman may be working on. In addition, magnets 30, 32 will also securely hold small iron or steel tools or parts, such as wrenches, sockets, screwdrivers, screws, nuts, bolts, washers, etc., for the workman so they will not be lost and so they will be conveniently at hand while he is working. This is particularly helpful in a confined work area, such as where there is room for only one of the workman's hands.

Figure 2:
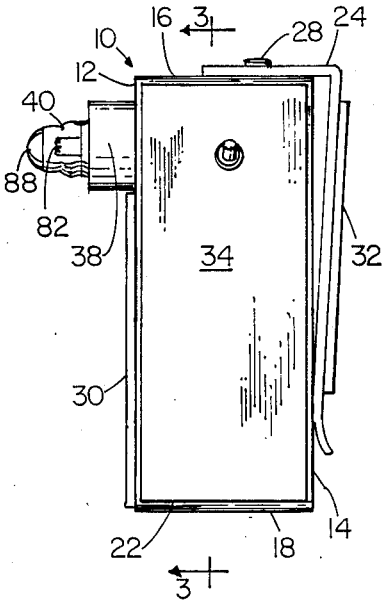
FIG. 2 is a side elevational view thereof.

Preferably, magnet 32 is located on the side of flashlight 10 which is opposite from flashlight bulb 40, to help enable the workman to more conveniently aim light from flashlight bulb 40 on his worksurface. Preferably, magnet 30 is located on the same side of flashlight 10 as flashlight bulb 40, to make using magnet 30 for holding small tools and parts more convenient for the user. As best seen in FIGS. 1 and 2, electrical socket 38 for flashlight bulb 40 extends outwardly from the front side 12 of flashlight 10. This enables light from flashlight bulb 40 to be projected directly on at least part of magnet 30, to help illuminate magnet 30. This is desireable since it permit said user to easily and clearly see any small objects that are magnetically held by magnet 30.

As seen in the FIGS., any conventional reflective material 34 could be secured by any conventional means, such as by gluing, to the side 22 and battery door 36 of flashlight 10. Although, for clarity, only side 22 and battery door 36 are shown being covered with reflective material 34, it is understood that reflective material 34 could be applied to any or all of the front 12, back 14, top 16, bottom 18, and side 20 of flashlight 10. In addition, reflective material 34 could also be applied to the outer surfaces of spring clip 24 and magnets 30, 32. Alternatively, instead of a reflective material 34, any conventional reflective coating 34 could be used. The purpose of reflective material or coating 34 is to reflect light, such as from the headlights of vehicles at night, as an additional safety feature for nighttime users of flashlight 10.

Figure 3:
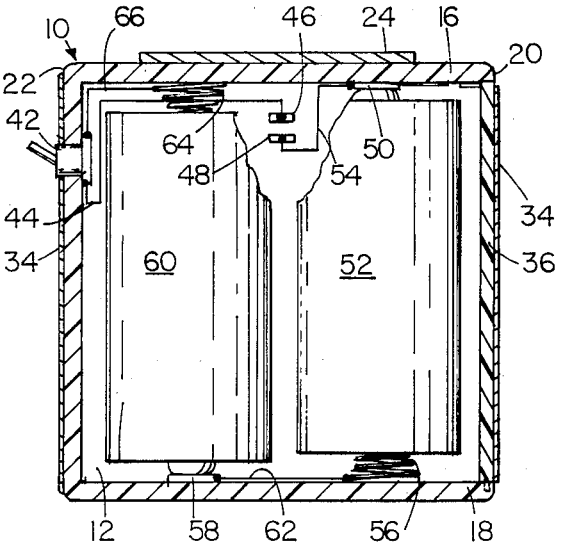
FIG. 3 is a cross-sectional view taken generally along line 3—3 of FIG. 2, with the batteries and some parts being shown in elevation.
Figure 4:
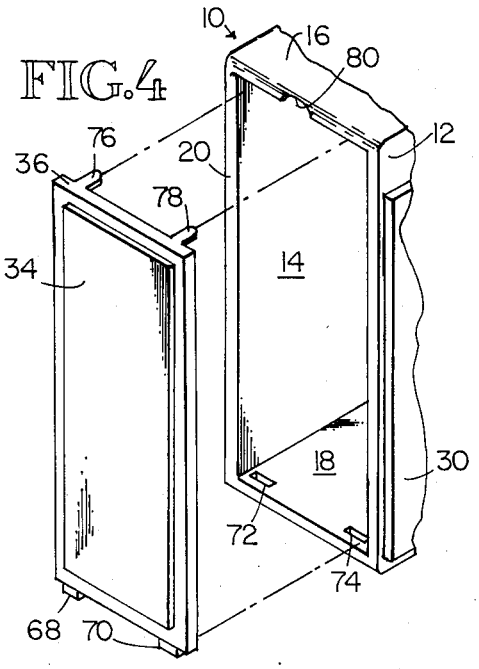
FIG. 4. is a partial exploded perspective view of one end of the present invention, in which the flashlight's battery door is seen.

Extending outwardly from one surface of flashlight 10 is a conventional electrical socket 38 for a conventional flashlight bulb 40. The electrical connections and wiring of flashlight 10 are best seen in FIG. 3. Starting at on/off switch 42, wire 44 connects the lower terminal of switch 42 in series with the upper terminal 46 of socket 38. The lower terminal 48 of socket 38 is connected in series to terminal plate 50 of battery 52 by wire 54. Spring terminal 56 of battery 52 is connected in series to terminal plate 58 of battery 60 by wire 62. Spring terminal 64 of battery 60 is connected in series to the upper terminal of switch 42 by wire 66. Spring terminals 56, 64 are in electrical contact with the negative ends of their respective batteries 52, 60; while terminal plates 50, 58 are in electrical contact with the positive ends of their respective batteries 52, 60. Thus, switch 42, socket 38, bulb 40 and batteries 52, 60 are electrically connected in series by wires 44, 54, 62 and 66.

Spring terminal 64 and terminal plate 50 are secured to the top 16 of flashlight 10, and spring terminal 56 and terminal plate 58 are secured to the bottom 18 of flashlight 10 by any conventional means, such as by gluing. Switch 42, which may be any suitable conventional electrical switch, is mounted in a hole provided for it in side 22 of flashlight 10 by any conventional means, such as by gluing. Socket 38 is secured to the front 12 of flashlight 10 by any conventional means, such as by gluing.

Batteries 52, 60 are inserted into and removed from flashlight 10 through a removable metal or plastic battery door 36. Located on the bottom of battery door 36 are a pair of mounting lugs 68, 70 which are adapted to be received in corresponding mounting slots 72, 74 in bottom 18 of flashlight 10. Located on the top of battery door 36 are a pair of resilient locking lugs 76, 78 which releasably engage the inside surface of the top 16 of flashlight 10 with a friction fit when battery door 36 is closed. In order to close battery door 36, its mounting lugs 68, 70 are inserted into their corresponding mounting slots 72, 74. Then battery door 36 is pivoted on its mounting lugs 68, 70 until its locking lugs 76, 78 frictionally engage the inside surface of the top 16 of flashlight 10. In order to open battery door 36 a fingertip or a small tool such as a screwdriver is inserted into finger recess 80 which permits the fingertip or tool to pry battery door 36 open.

As has been mentioned, and as best seen in FIGS. 1 and 2, electrical socket 38 for flashlight bulb 40 preferably extends outwardly from the front side 12 of flashlight 10. In addition, electrical socket 38 is preferably arranged so that it does not cover the filament 83 of flashlight bulb 40. Thus, light from flashlight bulb 40 is emitted in at least a hemispherical beam pattern, schematically indicated by circle 84, which is unobstructed by any part of flashlight 10. As a result, if flashlight 10 is held or worn at the user's side, so that its back 14 is facing the user, light from flashlight bulb 40 will illuminate the ground ahead of the user as well as at the user's feet, so that the user can see his or her way. In addition, light from flashlight bulb 40 will illuminate objects above the user, so that the user can work on overhead objects. Further, since light from flashlight bulb 40 will be emitted ahead of, above and behind the user, flashlight 10 acts as a good safety light, since it makes the user visible to others in all of those directions.

In addition, as is also seen in FIG. 1, flashlight bulb 40 emits light to the side of the user in a side beam pattern, as is schematically illustrated by side beam pattern 86. In this manner flashlight 10 makes the user visible to traffic coming from that side of the user, thereby further enhancing the safety of the user. Flashlight bulb 40 may be of the conventional type which has a lens 88 formed in its tip, thereby concentrating the light emitted from filament 82 into side beam pattern 86 and further increasing the visibility of the user.

In view of the forgoing, these and further modifications, adaptations and variations of the present invention will now be apparent to those skilled in the art to which it pertains, within the scope of the following claims. It is understood that the forgoing forms of the invention were described and/or illustrated strictly by way of non-limiting example.

What is claimed is:

1. A multipurpose flashlight comprising:

a flashlight bulb;

a housing means; wherein said housing means further includes a flashlight bulb socket means for mounting said flashlight bulb; and wherein said housing means defines an internal compartment that is sized and shaped to be adapted to receive at least one battery;

an electrical switch means mounted to said housing means; and electrical circuit means for electrically connecting said flashlight bulb, said at least one battery and said switch means to enable said at least one battery to supply electricity to said flashlight bulb when said switch means is on and to prevent said at least one battery from supplying electricity to said flashlight bulb when said switch means is off;

wherein said flashlight further comprises first and second magnets; wherein said first magnet is secured to a first magnet side of said housing means; wherein said second magnet is secured to a second magnet side of said housing means; wherein said first magnet has a strength that is sufficient to be adapted to magnetically fasten said flashlight in any orientation to a magnetically responsive surface to help permit a user to aim light emitted from said flashlight on a work surface; and wherein said second magnet is secured to said second magnet side of said housing means to help permit said user to more conveniently use said second magnet to magnetically hold objects for said user.

2. The flashlight according to claim 1, wherein said first magnet side and said second magnet side are located generally opposite from each other on said housing means.

3. The flashlight according to claim 1, wherein both said flashlight bulb and said second magnet are located on said second magnet side.

4. The flashlight according to claim 3, wherein said flashlight bulb socket means extends outwardly from second magnet side of said housing means to permit light from said flashlight bulb to be projected directly onto at least part of said second magnet, to help illuminate said second magnet to permit said user to see any said objects that are magnetically held by said second magnet.

5. The flashlight according to claim 1, wherein said housing means and said socket means are sized and shaped to not obstruct said flashlight bulb from radiating an at least generally hemispherical light beam pattern outwardly from said flashlight; wherein said housing means further comprises a securing means for releasably securing said flashlight to a user; wherein said securing means is located on said first side of said housing means; wherein said flashlight bulb is located on said second side of said housing means; and wherein said securing means and said flashlight bulb are located and oriented on their respective said first and second sides in such a way to enable said hemispherical light beam pattern to be generally projected from one side of said user when said flashlight is secured by said securing means to said one side of said user, to enable said flashlight to illuminate objects in front of, above, behind, to one side of, and at the feet of said user, and to enable said flashlight to project light ahead of, above, behind, and to one side of said user to make said user easily visible to others in all of those directions.

6. The flashlight according to claim 5, wherein said flashlight bulb socket means is not movable with respect to said second side of said housing means; and wherein said flashlight bulb socket means extends outwardly from said second side of said housing means to help enable said hemispherical light beam pattern to not be obstructed by said housing means.

7. The flashlight according to claim 5, wherein said flashlight bulb has a glass envelope; and wherein said glass envelope includes a lens means tat is located and oriented to focus light emitted from said flashlight bulb in a concentrated side beam pattern that is projected to said one side of said user to make said user more visible to vehicles approaching said user from said one side of said user.

8. The flashlight according to claim 1, wherein at least a portion of an external surface of said housing means has reflective material means located on said housing means for reflecting light from the headlights of vehicles to help make said user visible to drivers of said vehicles.

9. A multipurpose flashlight comprising:

a flashlight bulb;

a housing means; wherein said housing means includes a securing means for releasably securing said flashlight to a user; wherein said housing means further includes a flashlight bulb socket means for mounting said flashlight bulb; and wherein said housing means defines an internal compartment that is sized and shaped to be adapted to receive at least one battery;

an electrical switch means mounted to said housing means; and electrical circuit means for electrically connecting said flashlight bulb, said at least one battery and said switch means to enable said at least one battery to supply electricity to said flashlight bulb when said switch means is on and to prevent said at least one battery from supplying electricity to said flashlight bulb when said switch means is off;

wherein said housing means and said socket means are sized and shaped to not obstruct said flashlight bulb from radiating an at least generally hemispherical light beam pattern outwardly from said flashlight;

wherein said securing means is located on a first side of said housing means; wherein said flashlight bulb is located on a second side of said housing means; wherein said first and second sides are located on said housing means at least generally opposite each other; wherein said securing means and said flashlight bulb are located and oriented on their respective said first and second sides in such a way to enable said hemispherical light beam pattern to be generally projected from one side of said user when said flashlight is secured by said securing means to said one side of said user, to enable said flashlight to illuminate objects in front of, above, behind, to one side of, and at the feet of said user, and to enable said flashlight to project light ahead of, above, behind, and to one side of said user to make said user easily visible to others in all of those directions;

wherein said flashlight bulb socket means is not movable with respect to said second side of said housing means; and wherein said flashlight bulb socket means extends outwardly from said second side of said housing means to help enable said hemispherical light beam pattern to not be obstructed by said housing means.

10. The flashlight according to claim 9, wherein at least a portion of an external surface of said housing means has reflective material means located on said housing means for reflecting light from the headlights of vehicles to help make said user visible to drivers of said vehicles.

11. A multipurpose flashlight comprising:

a flashlight bulb;

a housing means; wherein said housing means includes a securing means for releasably securing said flashlight to a user; wherein said housing means further includes a flashlight bulb socket means for mounting said flashlight bulb; and wherein said housing means defines an internal compartment that is sized and shaped to be adapted to receive at least one battery;

an electrical switch means mounted to said housing means; and electrical circuit means for electrically connecting said flashlight bulb, said at least one battery and said switch means to enable said at least one battery to supply electricity to said flashlight bulb when said switch means is on and to prevent said at least one battery from supplying electricity to said flashlight bulb when said switch means is off;

wherein said housing means and said socket means are sized and shaped to not obstruct said flashlight bulb from radiating an at least generally hemispherical light beam pattern outwardly from said flashlight;

wherein said securing means is located on a first side of said housing means; wherein said flashlight bulb is located on a second side of said housing means; wherein said first and second side are located on said housing means at least generally opposite each other; and wherein said securing means and said flashlight bulb are located and oriented on their respective said first and second sides in such a way to enable said hemispherical light beam pattern to be generally projected from one side of said user when said flashlight is secured by said securing means to said one side of said user, to enable said flashlight to illuminate objects in front of, above, behind, to one side of, and at the feet of said user, and to enable said flashlight to project light ahead of, above, behind, and to one side of said user to make said user easily visible to others in all of those directions;

wherein said flashlight bulb has a glass envelope; and wherein said glass envelope includes a lens means that is located and oriented to form light emitted from said flashlight bulb in a concentrated side beam pattern that is projected to said one side of said user to make said user more visible to vehicles approaching said user from said one side of said user.

12. The flashlight according to claim 11, wherein at least a portion of an external surface of said housing means has reflective material means located on said housing means for reflecting light from the headlights of vehicles to help make said user visible to drivers of said vehicles.

13. A multipurpose flashlight comprising:

a flashlight bulb;

a housing means; wherein said housing means includes a securing means for releasably securing said flashlight to a user; wherein said housing means further includes a flashlight bulb socket means for mounting said flashlight bulb; and wherein said housing means defines an internal compartment that is sized and shaped to be adapted to receive at least one battery;

an electrical switch means mounted to said housing means; and electrical circuit means for electrically connecting said flashlight bulb, said at least one battery and said switch means to enable said at least one battery to supply electricity to said flashlight bulb when said switch means is one and to prevent said at least one battery from supplying electricity to said flashlight bulb when said switch means is off;

wherein said housing means and said socket means are sized and shaped to not obstruct said flashlight bulb from radiating an at least generally hemispherical light beam pattern outwardly from said flashlight;

wherein said securing means is located on a first side of said housing means; wherein said flashlight bulb is located on a second side of said housing means; wherein said first and second sides are located on said housing means at least generally opposite each other; and wherein said securing means and said flashlight bulb are located and oriented on their respective said first and second sides in such a way to enable said hemispherical light beam patter to be generally projected from one side of said user when said flashlight is secured by said securing means to said one side of said user, to enable said flashlight to illuminate objects in front of, above, behind, to one side of, and at the feet of said user, and to enable said flashlight to project light ahead of, above, behind, and to one side of said user to make said user easily visible to others in all of those directions:

wherein said flashlight further comprises first and second magnets; wherein said first magnet is secured to a first magnet side of said housing means; wherein said first magnet has a strength that is sufficient to be adapted to magnetically fasten said flashlight in any orientation to a magnetically responsive surface to help permit said user to aim light emitted from said flashlight on a work surface; and wherein said second magnet is secured to a second magnet side of said housing means, to help permit said user to more conveniently use said second magnet to magnetically hold objects for said user.

14. The flashlight according to claim 13, wherein said first magnet side and said second magnet side are located generally opposite from each other on said housing means.

15. The flashlight according to claim 13, wherein said second magnet side is the same as said second side

16. The flashlight according to claim 15, wherein said flashlight bulb socket means extends outwardly from second side of said housing means to permit light from said flashlight bulb to be projected directly onto at least part of said second magnet, to help illuminate said second magnet to permit said user to see any said objects that are magnetically held by said second magnet.

* * * * *